US011705631B2

(12) United States Patent
Sato

(10) Patent No.: US 11,705,631 B2
(45) Date of Patent: Jul. 18, 2023

(54) ANTENNA MODULE AND COMMUNICATION APPARATUS

(71) Applicant: Murata Manufacturing Co., Ltd., Nagaokakyo (JP)

(72) Inventor: Takuhiko Sato, Nagaokakyo (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 81 days.

(21) Appl. No.: 17/507,859

(22) Filed: Oct. 22, 2021

(65) Prior Publication Data

US 2022/0045424 A1 Feb. 10, 2022

Related U.S. Application Data

(63) Continuation of application No. PCT/JP2020/017181, filed on Apr. 21, 2020.

(30) Foreign Application Priority Data

Apr. 25, 2019 (JP) ..... 2019-084698

(51) Int. Cl.
*H01Q 3/38* (2006.01)
*H01Q 3/30* (2006.01)
(Continued)

(52) U.S. Cl.
CPC ..... *H01Q 3/38* (2013.01); *H01Q 3/30* (2013.01); *H01Q 21/22* (2013.01); *H01Q 25/00* (2013.01)

(58) Field of Classification Search
CPC ..... H01Q 1/2283; H01Q 21/065; H01Q 3/28; H01Q 3/38; H01Q 21/22; H01Q 25/00; H01Q 3/30; H01Q 3/24
See application file for complete search history.

(56) References Cited

U.S. PATENT DOCUMENTS 5,115,248 A * 5/1992 Roederer ..... H01Q 3/2658 342/368
10,374,663 B2 * 8/2019 Jackson ..... H04B 7/18528
(Continued)

FOREIGN PATENT DOCUMENTS

CN 108390703 B * 2/2021 ..... H01Q 1/288
EP 1143562 A1 * 10/2001 ..... H01Q 21/0087
(Continued)

OTHER PUBLICATIONS

International Search Report and Written Opinion dated Jul. 21, 2020, received for PCT Application PCT/JP2020/017181, Filed on Apr. 21, 2020, 8 pages including English Translation.

*Primary Examiner* — Vibol Tan
(74) *Attorney, Agent, or Firm* — Xsensus LLP

(57) ABSTRACT

An antenna module includes digital phase shifters, a plurality of antenna elements arranged in a first direction, and a fixed phase shifter. Each of the digital phase shifters changes a phase of a signal to a first phase value. The fixed phase shifter changes a phase of a signal to a second phase value, the second phase value being obtained by adding a predetermined offset phase value to the first phase value. A middle point of a virtual line is an antenna center and connects a center of an antenna element located on an end in the first direction and a center of an antenna element located on a different end. Under a symmetrical condition, an antenna center among the plurality of antenna elements are paired as an antenna element pair, the fixed phase shifter is electrically connected to at least one antenna element of the antenna element pair.

19 Claims, 11 Drawing Sheets

(51) Int. Cl.
*H01Q 21/22* (2006.01)
*H01Q 25/00* (2006.01)

(56) References Cited

U.S. PATENT DOCUMENTS

| | | | | |
|---|---|---|---|---|
| 11,128,331 | B2 * | 9/2021 | Rainov | H01Q 3/38 |
| 11,218,203 | B1 * | 1/2022 | Lee | H04B 7/0617 |

FOREIGN PATENT DOCUMENTS

| | | | | |
|---|---|---|---|---|
| EP | 1146593 | A1 * | 10/2001 | H01Q 21/0087 |
| EP | 2975688 | A1 * | 1/2016 | H01Q 1/246 |
| JP | 2-90804 | A | 3/1990 | |
| JP | 3-165104 | A | 7/1991 | |
| JP | 2008-312197 | A | 12/2008 | |
| JP | 2009-218677 | A | 9/2009 | |
| JP | 2011-44774 | A | 3/2011 | |
| JP | 2015-1429 | A | 1/2015 | |

* cited by examiner

ANTENNA MODULE AND COMMUNICATION APPARATUS

CROSS-REFERENCE TO RELATED APPLICATIONS

The present application is a continuation of and claims priority to PCT/JP2020/017181, filed Apr. 21, 2020 which claims priority to JP 2019-084698, filed Apr. 25, 2019, the entire contents of each of which being incorporated herein by reference.

TECHNICAL FIELD

The present disclosure relates to an antenna module and a communication apparatus.

BACKGROUND ART

The following Patent Document 1 describes an antenna element that controls the directivity of electronic waves radiated from antennas, the directivity being controlled by using digital phase shifters.

CITATION LIST

Patent Document

Patent Document 1: Japanese Unexamined Patent Application Publication No. 2-90804

SUMMARY

Technical Problems

In Patent Document 1, analog phase shifters in addition to the digital phase shifters are connected to some of the antenna elements. Accordingly, a circuit scale is likely to be increased. In another aspect, the use of only the digital phase shifters leads to an increase in a difference between a phase discretely changed by each digital phase shifter and an ideal phase and thus to a possibility of an increase in a side lobe.

It is an aspect of the present disclosure to provide an antenna module and a communication apparatus each of which can reduce an increase in a circuit scale and can also lower a side lobe.

Solutions to Problems

An antenna module according to an aspect of the present disclosure includes: a plurality of antenna elements that are arranged in a first direction; a fixed phase shifter; and a plurality of digital phase shifters that are each in a signal path to a corresponding one of the plurality of antenna elements, wherein each of the plurality of digital phase shifters changes a phase of a signal to a first phase value provided discretely as the signal propagates through to a corresponding one of the plurality of antenna elements, the fixed phase shifter further changes the phase of the signal to a second phase value as the signal propagates through to the one of the plurality of antenna elements, the second phase value being obtained by adding a predetermined offset phase value to the first phase value, a middle point of a virtual line is set as an antenna center, the virtual line connecting, among the plurality of antenna elements arranged in the first direction, a center of an antenna element located on an end in the first direction and a center of an antenna element located on a different end in the first direction, and under a condition two antenna elements arranged in locations symmetrical with respect to the antenna center among the plurality of antenna elements arranged in the first direction are paired as an antenna element pair, and the fixed phase shifter is electrically connected to at least one antenna element of the antenna element pair.

An antenna module according to another aspect of the present disclosure includes: a plurality of antenna elements; a plurality of digital phase shifters that are each in a signal path to a corresponding one of the plurality of antenna elements, and a fixed phase shifter that changes a phase of a signal from a first phase value to a second phase value as the signal propagates through to one of the plurality of antenna elements, the second phase value being obtained by adding a predetermined offset phase value to a first phase value provided discretely by a corresponding one of the plurality of digital phase shifters, wherein the plurality of antenna elements include a plurality of first-group antenna elements and a plurality of second-group antenna elements that are composed of antenna elements not included in the plurality of first-group antenna elements, and the fixed phase shifter is connected to at least one antenna element among the plurality of first-group antenna elements and an antenna element among the plurality of second-group antenna elements.

A communication apparatus according to an aspect of the present disclosure includes the antenna module described above; and a baseband integrated circuit that supplies a baseband signal to the antenna module.

Advantageous Effects

According to the present disclosure, it is possible to reduce an increase in a circuit scale and also lower a side lobe.

DESCRIPTION OF EMBODIMENTS

Hereinafter, embodiments of an antenna module and a communication apparatus of the present disclosure will be described in detail based on the drawings. Note that the embodiments do not limit the present disclosure. It goes without saying that each embodiment is exemplification and configurations illustrated in different embodiments can be partially replaced or combined. After a second embodiment, the description of a matter common to that in a first embodiment is omitted, and one or more different points will only be described. In particular, the same advantageous effects and operations of the same configuration are not referred to in each embodiment.

First Embodiment

Figure 1:
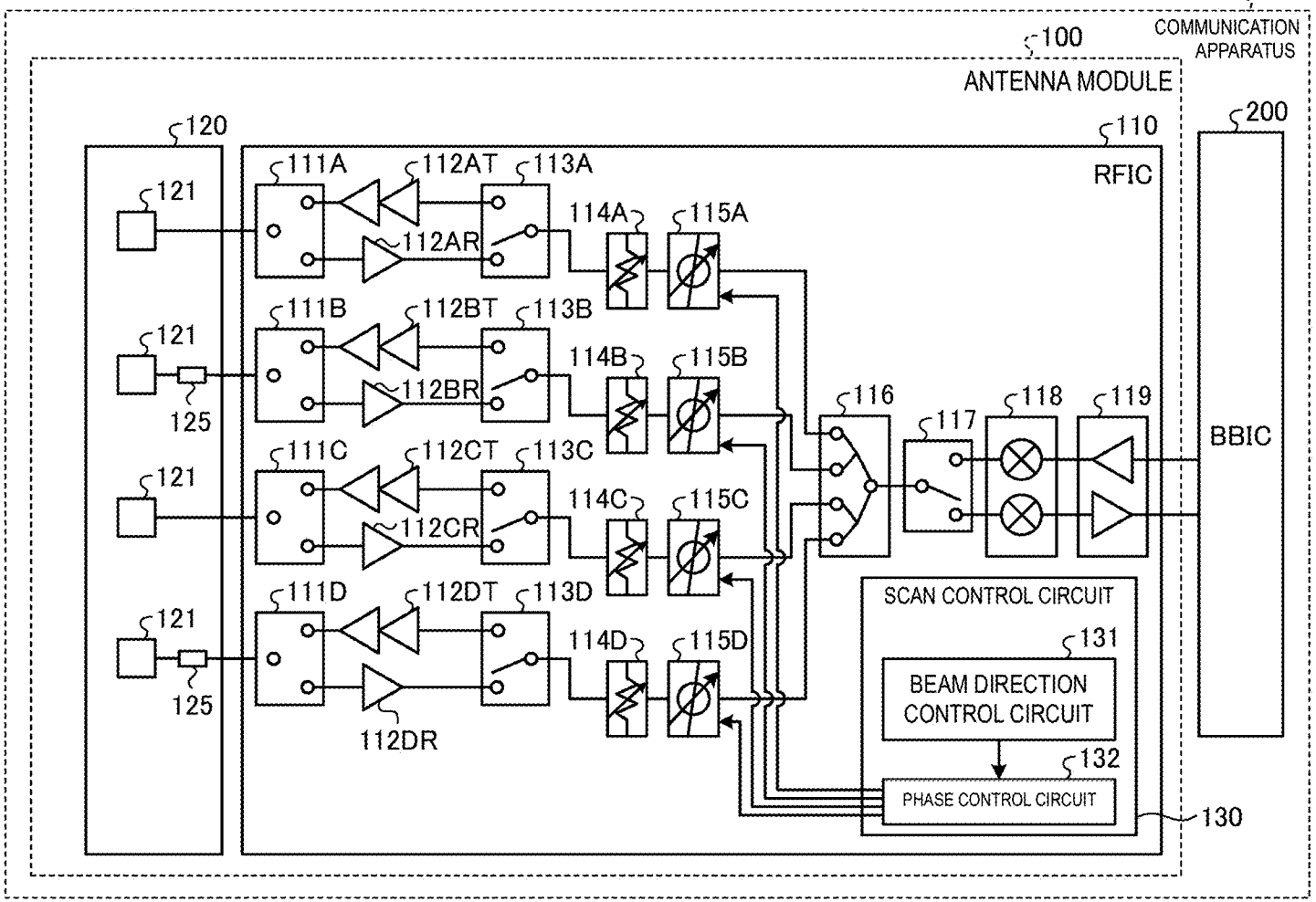
FIG. 1 is a block diagram illustrating the configuration of a communication apparatus according to a first embodiment.

FIG. 1 is a block diagram illustrating the configuration of a communication apparatus according to the first embodiment. A communication apparatus 10 is, for example, a mobile terminal such as a mobile phone, a smartphone, or a tablet terminal, or a personal computer having a communication function. Alternatively, the communication apparatus 10 may perform backhaul communication as communication between base stations or communication between a base station and a core network.

As illustrated in FIG. 1, the communication apparatus 10 includes an antenna module 100 and a baseband integrated circuit (hereinafter, referred to as a BBIC) 200. The antenna module 100 includes an antenna array 120 and a radio frequency integrated circuit (RFIC) 110 that is an example of a feeder circuit. The BBIC 200 configures a baseband signal processing circuit. The BBIC 200 supplies the antenna module 100 with baseband signals.

The communication apparatus 10 upconverts a signal transmitted from the BBIC 200 to the antenna module 100 to a high-frequency signal and radiates the signal from the antenna array 120. The communication apparatus 10 also downconverts a high-frequency signal received by the antenna array 120 and thereby processes the signal at the BBIC 200.

Note that for easy explanation, FIG. 1 illustrates a configuration corresponding to only four antenna elements 121 of a plurality of antenna elements 121 included in the antenna array 120, and a configuration corresponding to the other antenna elements 121 having the same configuration is omitted. For this embodiment, a case where each antenna element 121 is a patch antenna of a rectangular planer shape is described as an example. This four element configuration is for illustration purposes only and it should be clear from the present teachings that the antenna array may include N antenna elements, and corresponding components, where N is an integer of 2 or larger than 2.

The RFIC 110 includes switches 111A, 111B, 111C, 111D, 113A, 113B, 113C, 113D, and 117, power amplifiers 112AT, 112BT, 112CT, and 112DT, low noise amplifiers 112AR, 112BR, 112CR, and 112DR, attenuators 114A, 114B, 114C, and 114D, digital phase shifters 115A, 115B, 115C, and 115D, a signal multiplexer/demultiplexer 116, a mixer 118, and an amplifier circuit 119.

In transmitting a "high-frequency" signal, switching to the power amplifiers 112AT, 112BT, 112CT, and 112DT is performed on the switches 111A, 111B, 111C, 111D, 113A, 113B, 113C, and 113D. The switch 117 is connected to an amplifier for transmission in the amplifier circuit 119. As used herein the term "high-frequency" is not intended to refer to the HF band (3 MHz to 30 MHz), but rather frequencies in the radio-frequency (RF) spectrum such as the quasi-millimeter wave range and the mm wave range, including 24 GHz to 300 GHz. Moreover, when used herein, high-frequency can be construed as RF.

A signal transmitted from the BBIC 200 is amplified by the amplifier circuit 119 and upconverted by the mixer 118. The transmission signal that is the upconverted high-frequency signal is demultiplexed to four signals by the signal multiplexer/demultiplexer 116. The signals pass through four respective signal paths and fed to the respective differed antenna elements 121. At this time, the phase values of the respective digital phase shifters 115A, 115B, 115C, and 115D arranged in the signal paths are individually adjusted, and thereby the directivity of the antenna array 120 can be adjusted.

In receiving a high-frequency signal, switching to the low noise amplifiers 112AR, 112BR, 112CR, and 112DR is performed on the switches 111A, 111B, 111C, 111D, 113A, 113B, 113C, and 113D. The switch 117 is connected to an amplifier for reception in the amplifier circuit 119.

The reception signal that is a high-frequency signal received by the antenna element 121 pass through four respective signal paths and multiplexed by the signal multiplexer/demultiplexer 116. The multiplexed reception signal is downconverted by the mixer 118, amplified by the amplifier circuit 119, and transmitted to the BBIC 200.

The RFIC 110 further includes a scan control circuit 130. The scan control circuit 130 is a circuit that controls a beam direction Db in transmission and a beam direction Db in reception. The scan control circuit 130 includes a beam direction control circuit 131 and a phase control circuit 132. The beam direction control circuit 131 outputs, to the phase control circuit 132, a control signal based on the beam direction Db in transmission or the beam direction Db in reception. The phase control circuit 132 calculates the phase of each signal propagating through to the corresponding antenna element 121 based on the control signal from the beam direction control circuit 131 and outputs a phase command value φa to a corresponding one of the digital phase shifters 115A, 115B, 115C, and 115D. The scan control circuit 130 may be implemented with one or more programmable central processing units with access to memory-based look-up tables that store weighting coefficients. The scan control circuit 130 may also be implemented with a dedicated hardwired circuit such as programmable array logic (PAL) or an application specific integrated circuit (ASIC). Furthermore, the scan control circuit 130 may include multiple processors, PALs, and/or ASICs in a hybrid configuration. As discussed below, the scan control circuit 130 may be one portion of the RFIC 110 when it is embodied as an integrated circuit.

Each of the digital phase shifters 115A, 115B, 115C, and 115D changes the phase of a signal propagating through to the corresponding antenna element 121 to one of first phase values I1, I2, I3, and I4 (see FIG. 5) based on the phase command value φa.

In addition, one or more fixed phase shifters 125 are connected to at least one or more antenna elements 121 of the plurality of antenna elements 121. Each fixed phase shifter 125 changes the phase of a signal propagating through to the corresponding antenna element 121, to one of second phase values J1, J2, J3, and J4 (see FIG. 5). The second phase values J1, J2, J3, and J4 are phase values each obtained by adding a predetermined offset phase value pos to a corresponding one of the first phase values I1, I2, I3, and I4 discretely provided by the digital phase shifters 115A, 115B, 115C, and 115D.

The RFIC 110 is formed, for example, as an integrated circuit component, as one chip, having the above-described circuit configuration. Alternatively, devices (a switch, a power amplifier, a low noise amplifier, an attenuator, and a digital phase shifter) for each antenna device 121 in the RFIC 110 may be formed as an integrated circuit component as one chip for the antenna element 121. The configuration of the scan control circuit 130 is not limited to the configuration in which the scan control circuit 130 is included in the RFIC 110, and the scan control circuit 130 may be provided, for example, in the communication apparatus 10, without being included in the RFIC 110.

Figure 2:
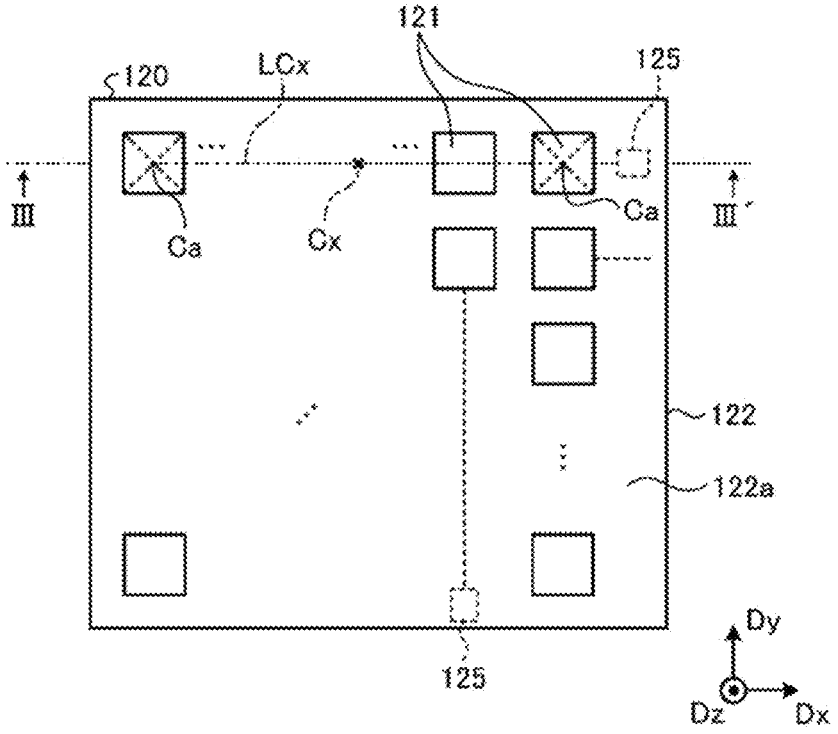
FIG. 2 is a plan view illustrating an antenna array.

The configuration of the antenna array 120 will now be described. FIG. 2 is a plan view illustrating an antenna array. As illustrated in FIG. 2, the antenna array 120 includes a substrate 122 provided with the plurality of antenna elements 121. For example, a ceramics multi-layer substrate is used for the substrate 122. As the ceramics multi-layer substrate, for example, a low temperature co-fired ceramics (LTCC) multi-layer substrate is used. Note that the substrate 122 may be a multi-layer resin substrate formed by laminating a plurality of resin layers formed from resins such as epoxy and polyimide. The substrate 122 may also be a multi-layer resin substrate formed by laminating a plurality of resin layers formed from a liquid crystal polymer (LCP) having a low permittivity, may also be a multi-layer resin substrate formed by laminating a plurality of resin layers formed from fluorine-based resins, and may also be a ceramics multi-layer substrate sintered at a higher temperature than that for the LTCC.

The plurality of antenna elements 121 are arranged in a first direction Dx and also arranged in a second direction Dy in a plan view. The first direction Dx and the second direction Dy are directions parallel to a first main surface 122*a* of the substrate 122. For example, the first direction Dx is a direction extending along a side of the substrate 122. The second direction Dy is orthogonal to the first direction Dx. A third direction Dz is a direction orthogonal to the first direction Dx and the second direction Dy. That is, the third direction Dz is a direction perpendicular to the first main surface 122*a* of the substrate 122.

Figure 3:
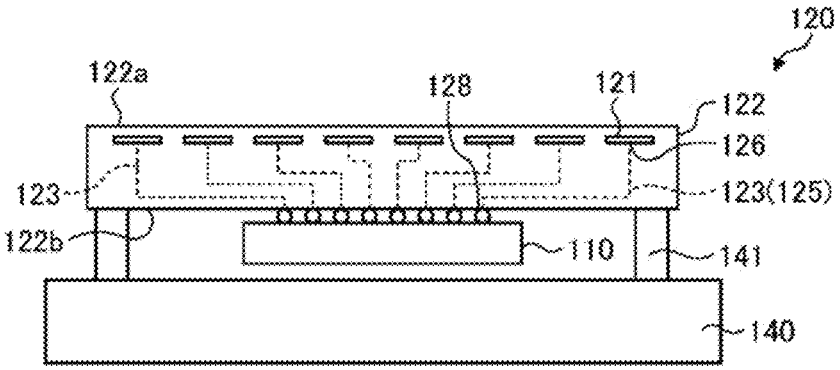
FIG. 3 is a cross sectional view taken along III-III' in FIG. 2.

FIG. 3 is a cross sectional view taken along III-III' in FIG. 2. As illustrated in FIG. 3, the substrate 122 is arranged facing a mother board 140. The substrate 122 is electrically connected to the mother board 140 with a terminal 141 interposed therebetween.

The RFIC 110 is provided on a second main surface 122*b* of the substrate 122. The plurality of antenna elements 121 are provided in a portion of the substrate 122, the portion being, co-planar with, and closer to the first main surface 122*a*. The plurality of antenna elements 121 are provided in an inner layer of the substrate 122. However, the configuration is not limited to this. The configuration may be a configuration having the plurality of antenna elements 121 on a surface of the substrate 122 and a protective layer covering the plurality of antenna elements 121.

The plurality of antenna elements 121 are electrically connected to the RFIC 110 with respective transmission lines 123 interposed therebetween. Each transmission line 123 includes a wiring line (or more generally a conductor) included in the substrate 122 and a via provided between layers. One end of the transmission line 123 is connected to a feeding point 126 of the corresponding antenna element 121, and a different end of the transmission line 123 is connected to a terminal 128 of the RFIC 110.

The second phase values J1, J2, J3, and J4 of each fixed phase shifter 125 can be adjusted by changing the line length of the corresponding transmission line 123. For example, in an antenna element 121 not connected to a fixed phase shifter 125, the line length of the transmission line 123 is a line length La. In addition, in an antenna element 121 connected to a fixed phase shifter 125, the line length of the transmission line 123 is a line length Lb. A length obtained by normalizing the line length Lb by a wavelength λ and a length obtained by normalizing the line length La by using the wavelength λ are made different, and thereby the fixed phase shifter 125 is configured. Specifically, assume that in a case where a fixed phase shifter 125 provides a phase difference of, for example, 45 degrees, the wavelength of a signal at the transmission line 123 is λε. In this case, the line lengths La and Lb satisfy Formula (1) below. More specifically, for example, at the time of a wavelength in a vacuum of 5 mm (a frequency of about 60 GHz) and a relative permittivity ε of the substrate 122=4, the wavelength $\lambda\varepsilon=5/\sqrt{4}=2.5$ mm holds true for the wavelength λε. Based on Formula (1), a difference between the line length La and the line length Lb is La−Lb=2.5 mm (45/360)=0.3125 mm.

$$La-Lb=\lambda\varepsilon\times(u+45/360) \quad (1),$$

where u is an integer.

Figure 4:
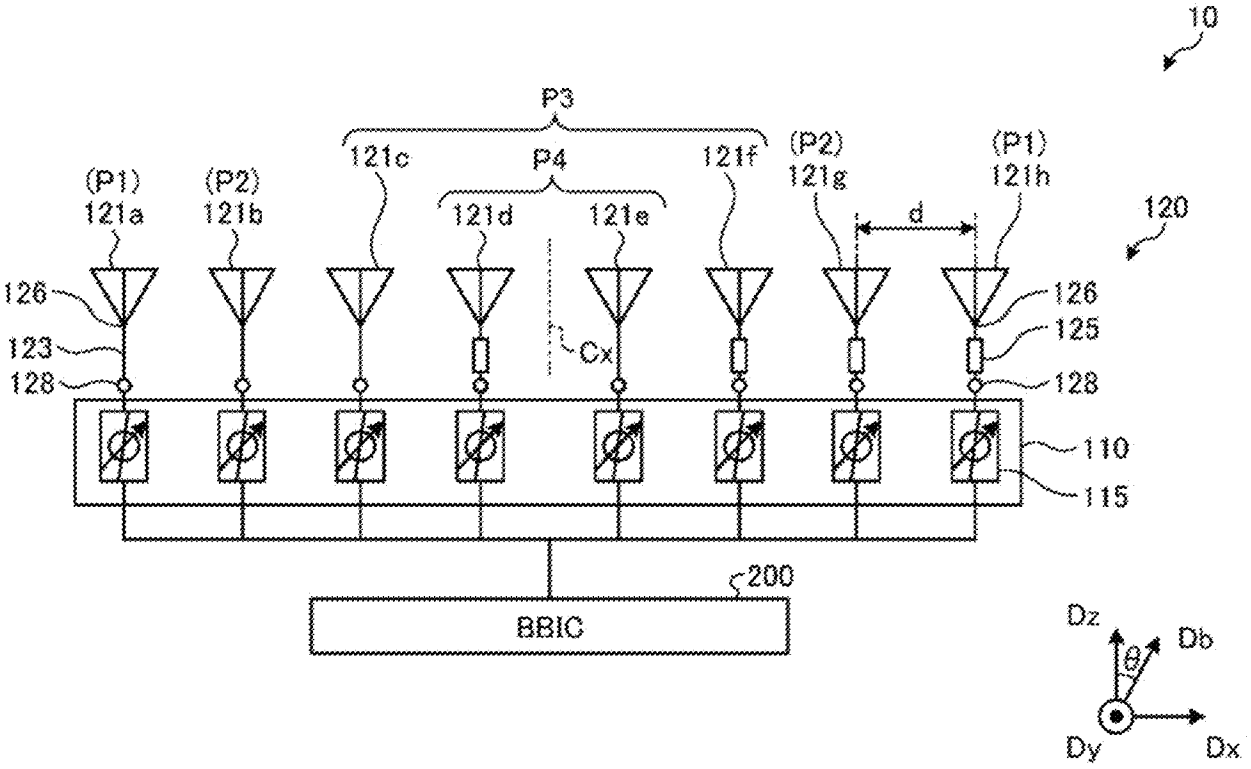
FIG. 4 is an explanatory diagram for explaining a connection relationship among a plurality of antenna elements and fixed phase shifters.

FIG. 4 is an explanatory diagram for explaining a connection relationship among a plurality of antenna elements and fixed phase shifters. For easy understanding of explanation, the plurality of antenna elements 121 arranged in the first direction Dx are described with reference to FIG. 4.

As illustrated in FIG. 4, for example, the eight antenna elements 121*a* to 121*h* are arranged in the first direction Dx in the antenna array 120. When not being required to be described in a discriminated manner in the following description, each of the antenna elements 121*a* to 121*h* is simply referred to as an antenna element 121.

Among the plurality of antenna elements 121, two antenna elements 121 arranged in locations symmetrical with respect to an antenna center Cx serve as one of antenna element pairs P1, P2, P3 and P4. The antenna center Cx is herein the middle point of a virtual line LCx connecting, among the plurality of antenna elements 121 arranged in the first direction Dx, an antenna element center Ca (see FIG. 2) of the antenna element 121*a* located on one end in the first direction Dx and an antenna element center Ca of the antenna element 121*h* located on a different end in the first direction Dx. The antenna element center Ca is located at the center of gravity of each antenna element 121 in a plan view as illustrated in FIG. 2 and overlaps with the position of the intersection of diagonals when the antenna element 121 is a rectangle.

Note that in this embodiment, the expression "locations symmetrical" denotes, for example, arrangement performed in such a manner that the antenna element center Ca of the antenna element 121*a* and the antenna element center Ca of the antenna element 121*h* are symmetrical. However, the expression is not limited to this and includes a case where a location symmetrical to the antenna element center Ca of the antenna element 121*a* overlaps with a portion of the antenna element 121*h* shifted from the antenna element center Ca of the antenna element 121*h*.

The antenna element pair P1 is composed of the antenna element 121*a* and the antenna element 121*h*. The antenna element pair P2 is composed of the antenna element 121*b* and the antenna element 121*g*. The antenna element pair P3 is composed of the antenna element 121*c* and the antenna element 121*f*. The antenna element pair P4 is composed of the antenna element 121*d* and the antenna element 121*e*.

Each fixed phase shifter 125 is connected to a corresponding one of the antenna elements 121*d*, 121*f*, 121*g*, and 121*h* each of which is one of a corresponding one of the antenna element pairs P1, P2, P3 and P4. That is, each of the antenna elements 121*d*, 121*f*, 121*g*, and 121*h* that serves as one of the pair is connected to a corresponding one of the digital phase shifters 115 with the corresponding fixed phase shifter 125 interposed therebetween. Each of the antenna elements 121*a*, 121*b*, 121*c*, and 121*e* that serves as a different one of a corresponding one of the antenna element pairs P1, P2, P3 and P4 is connected to the corresponding digital phase shifter 115 without any fixed phase shifter 125 interposed therebetween.

Figure 5:
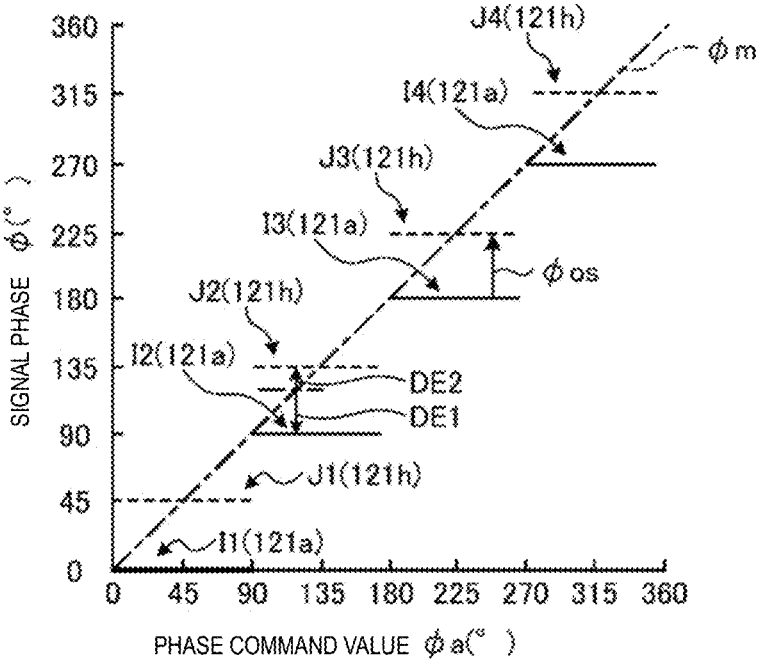
FIG. 5 is a graph schematically illustrating relationships between a phase command value for a signal propagating through to an antenna element and a first phase value provided by a digital phase shifter and between the phase command value and a second phase value provided by a fixed phase shifter.

The operations of the fixed phase shifters 125 and the digital phase shifters 115 will now be described with reference to FIGS. 4 and 5. FIG. 5 is a graph schematically illustrating relationships between a phase command value for a signal propagating through to an antenna element and a first phase value provided by a digital phase shifter and between the phase command value and a second phase value provided by a fixed phase shifter.

The horizontal axis of the graph illustrated in FIG. 5 represents the phase command value φa and a command value output from the phase control circuit 132 (see FIG. 1). The phase command value φa is a command value for controlling the phase of a signal propagating through to an antenna element 121 at the time when the beam direction Db with respect to the antenna array 120 is inclined at an angle θ with the third direction Dz. The vertical axis of the graph illustrated in FIG. 5 represents the phase φ of the signal propagating through to the antenna element 121. If the phase of the signal propagating through to the antenna element 121 coincides with an ideal phase value φm, an error between the phase of the signal propagating through to the antenna element 121 and the phase command value φa can be reduced.

When the signals in the same phase are fed to the respective feeding points 126 of the plurality of antenna elements 121, the antenna array 120 has directivity in the third direction Dz. If the beam direction Db is inclined at the angle θ with the third direction Dz, the ideal phase value φm of each signal propagating through to the corresponding antenna element 121 is expressed by Formula (2) below.

$$\varphi m = k \times m \times d \times \sin\theta \quad (2),$$

where k is a wave number k in the free space and expressed as $k=2\pi/\lambda$ (λ is the wavelength of a signal propagating through to an antenna element 121); m is an element number m of the antenna element 121, and is assigned m=1, 2, . . . , or 8 according to the order in which the antenna elements 121*a* to 121*h* are arranged; and d is an antenna element distance d. The antenna element distance d is a distance between the antenna element center Ca of adjacent antenna elements 121.

For easy understanding of explanation, signals propagating through to the antenna element pair P1 (the antenna elements 121*a* and 121*h*) among the antenna element pairs P1, P2, P3 and P4 are hereinafter described. In the example illustrated in FIG. 5, each digital phase shifter 115 has a quantization bit i of 2 and one of the four first phase values I1, I2, I3, and I4. The first phase values I1, I2, I3, and I4 are discretely set every $2\pi/2^i$, where i is the number of the quantization bits i, and i=2 holds true in the example illustrated in FIG. 5. Specifically, the first phase values I1, I2, I3, and I4 are respectively 0 degrees, 90 degrees, 180 degrees, and 270 degrees. Note that the quantization bit i may be 1 or may be 3 or more.

One of the digital phase shifters 115 changes the phase φ of the signal propagating through to the antenna element 121*a* of the antenna element pair P1 to one of the first phase values I1, I2, I3, and I4 set discretely. For example, if the phase command value φa is higher than or equal to 0 degrees and is lower than 90 degrees, the digital phase shifter 115 changes the phase φ to the first phase value I1=0 degrees. If the phase command value φa is higher than or equal to 90 degrees and is lower than 180 degrees, the digital phase shifter 115 changes the phase φ to the first phase value I2=90 degrees. If the phase command value φa is higher than or equal to 180 degrees and is lower than 270 degrees, the digital phase shifter 115 changes the phase φ to the first phase value I3=180 degrees. If the phase command value φa is higher than or equal to 270 degrees and is lower than 360 degrees, the digital phase shifter 115 changes the phase φ to the first phase value I4=270 degrees.

One of the fixed phase shifters 125 changes the phase of the signal propagating through to the antenna element 121*h* to one of the second phase values J1, J2, J3, and J4. The second phase values J1, J2, J3, and J4 are phase values each obtained by adding the predetermined offset phase value pos to a corresponding one of the first phase values I1, I2, I3, and I4 discretely provided by the corresponding digital phase shifter 115. The offset phase value pos may be set according to a difference between the lengths respectively obtained by normalizing the line length Lb and the line length La by using the wavelength λ.

The offset phase value pos is a phase value that is half of a difference between adjacent ones of the plurality of first phase values I1, I2, I3, and I4 of the digital phase shifter 115. In the example illustrated in FIG. 5, the difference (digitization distance) between adjacent ones of the first phase values I1, I2, I3, and I4 is 90 degrees, and the offset phase value pos is 45 degrees that is half thereof. That is, the second phase values J1, J2, J3, and J4 are respectively 45 degrees, 135 degrees, 225 degrees, and 315 degrees.

For example, if the phase command value φa is higher than or equal to 0 degrees and is lower than 90 degrees, the fixed phase shifter 125 changes the phase φ to the second phase value J1=45 degrees. If the phase command value φa is higher than or equal to 90 degrees and is lower than 180 degrees, the fixed phase shifter 125 changes the phase φ to the second phase value J2=135 degrees. If the phase command value φa is higher than or equal to 180 degrees and is lower than 270 degrees, the fixed phase shifter 125 changes the phase φ to the second phase value J3=225 degrees. If the phase command value φa is higher than or equal to 270 degrees and is lower than 360 degrees, the fixed phase shifter 125 changes the phase φ to the second phase value J4=315 degrees.

Here, a difference between a phase φ (one of the first phase values I1, I2, I3, and I4) changed by the digital phase shifter 115 and an ideal phase value φm is a first quantization error DE1. In addition, a difference between a phase φ (one of the second phase values J1, J2, J3, and J4) changed by the digital phase shifter 115 and the fixed phase shifter 125 and the ideal phase value φm is a second quantization error DE2.

For example, if the phase command value φa is 0 degrees, the first quantization error DE1 is 0 degrees, and the second quantization error DE2 is 45 degrees. That is, if the beam direction Db is taken in the third direction Dz (0=0 degrees), providing the fixed phase shifter 125 causes a total of the quantization errors to be increased on occasions.

In contrast, inclining the beam direction Db at the angle θ with the third direction Dz causes the respective ideal phase values φm to vary with the plurality of antenna elements 121, based on Formula (2) described above, and the phase command values φa according to these are set for the respective antenna elements 121.

For example, if the respective phase command values φa of the antenna element 121*a* and the antenna element 121*h* are respectively 60 degrees and 120 degrees, the first quantization error DE1 and the second quantization error DE2 are respectively −60 degrees and 15 degrees. That is, if the beam direction Db is inclined at the angle θ with the third direction Dz, the mean value of the quantization errors of the antenna element pair P1 is reduced compared with a configuration in which the phases are controlled by using only the digital phase shifters 115. Note that FIG. 5 illustrates the antenna element pair P1 (the antenna elements 121*a* and 121*h*), but the same holds true for the antenna element pairs P2, P3 and P4 (the antenna elements 121*b* to 121*g*).

As the result of this, according to the antenna module 100 and the communication apparatus 10 in this embodiment, the mean value of side lobes based on the first quantization error DE1 and the second quantization error DE2 can be lowered in the beam pattern of the antenna array 120. In addition, in each of the antenna element pairs P1, P2, P3 and P4, a corresponding one of the antenna elements 121*d*, 121*f*, 121*g*, and 121*h* connected with the fixed phase shifters 125 and a corresponding one of the antenna elements 121*a*, 121*b*, 121*c*, and 121*e* not connected with the fixed phase shifters 125 are provided in the location symmetrical with respect to the antenna center Cx. This enables side lobe levels to be lowered effectively.

Each fixed phase shifter 125 is provided in the substrate 122 and configured by using the corresponding transmission line 123 electrically connecting the corresponding antenna element 121 and the RFIC 110. An increase in the circuit scale of the RFIC 110 can thus be reduced compared with a configuration in which analog phase shifters in addition to the digital phase shifters 115 are provided and a case where the number of bits for the digital phase shifters 115 is increased.

Note that the configuration of the communication apparatus 10 of this embodiment may be appropriately changed. For example, the plurality of antenna elements 121 are not limited to the patch antenna, and may have a different configuration such as for a flat horn antenna. In addition, the number of antenna elements 121 arranged in the first direction Dx may be 9 or more or may be 7 or less.

Figure 6:
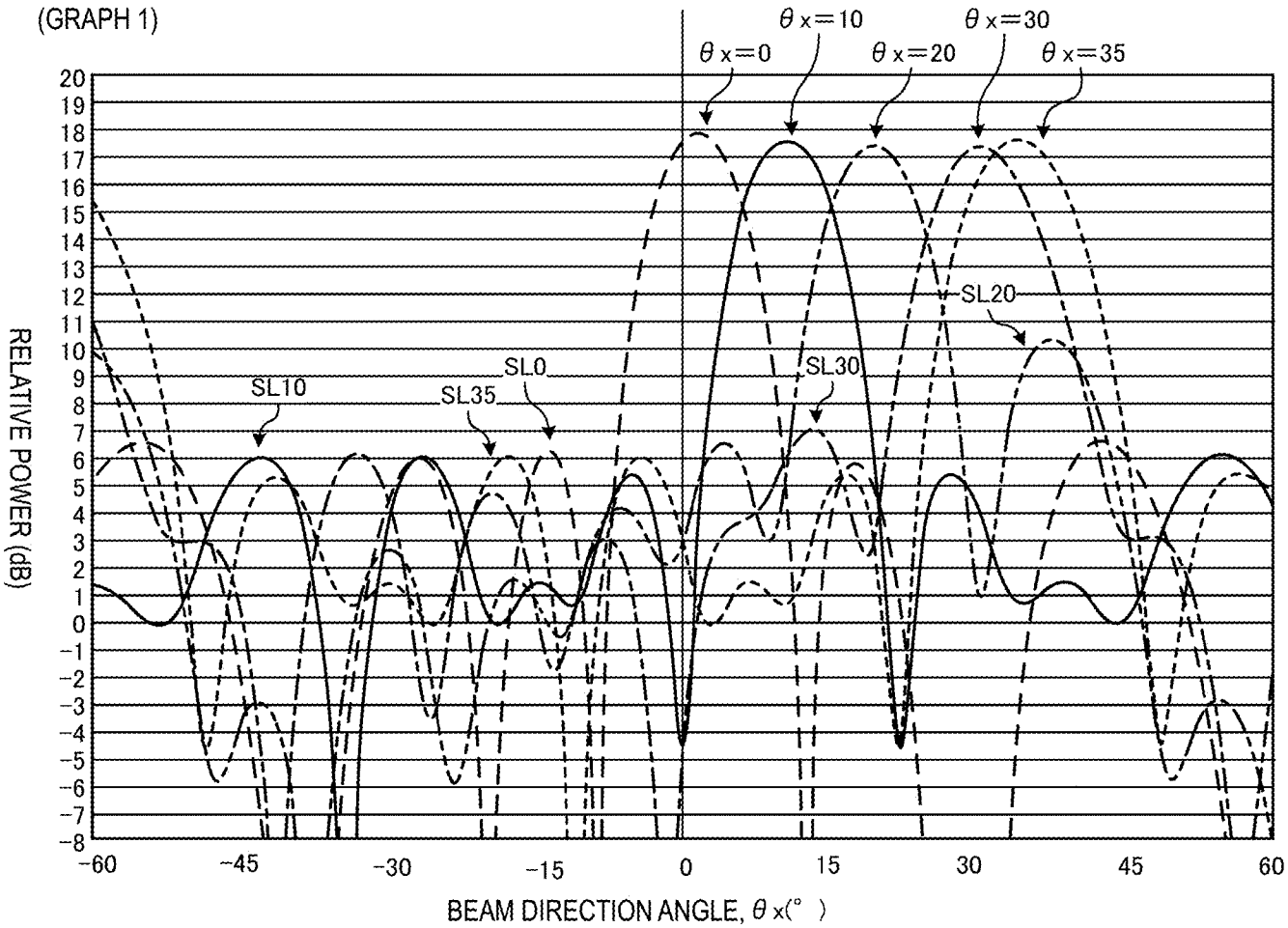
FIG. 6 is a graph illustrating a relationship between a beam direction and relative power in a communication apparatus according to an embodiment example.
Figure 7:
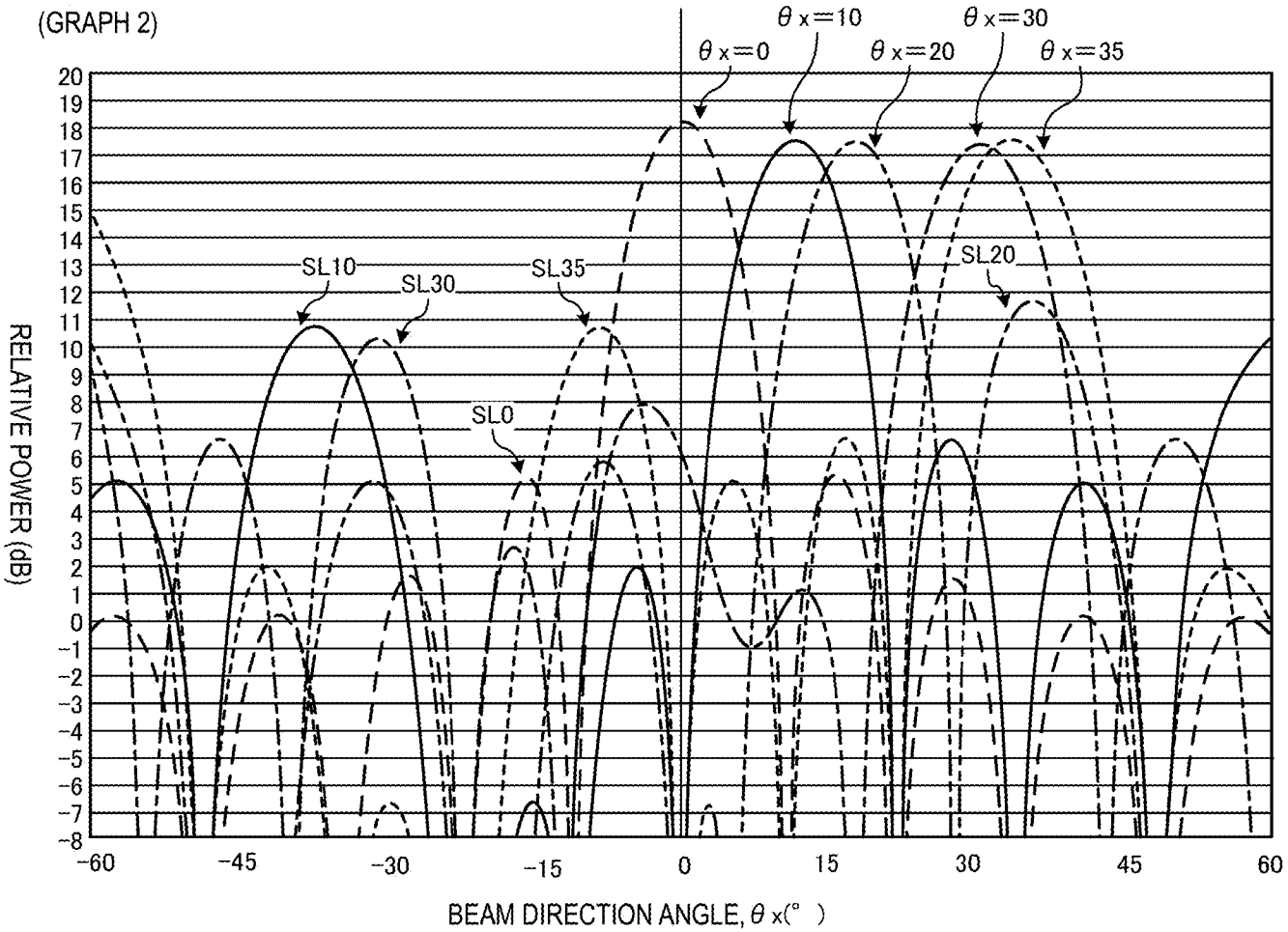
FIG. 7 is a graph illustrating a relationship between a beam direction and relative power in a communication apparatus according to a comparison example.

FIG. 6 is a graph illustrating a relationship between a beam direction and relative power in a communication apparatus according to an embodiment example. FIG. 7 is a graph illustrating a relationship between a beam direction and relative power in a communication apparatus according to a comparison example. Like the example illustrated in FIG. 4, the communication apparatus according to the embodiment example illustrated in FIG. 6 represents beam patterns in the communication apparatus 10 with the fixed phase shifters 125 connected to the antenna elements 121*d*, 121*f*, 121*g*, and 121*h*. The communication apparatus according to the comparison example illustrated in FIG. 7 represents a configuration in which the fixed phase shifters 125 are not connected and the phases of all of the antenna elements 121 are controlled by the digital phase shifters 115.

In Graphs 1 and 2 respectively illustrated in FIGS. 6 and 7, the horizontal axis represents an angle θx with the beam direction Db, and the vertical axis represents relative power. The angle θx represents the angle of the main beam made with the third direction Dz. Each of Graphs 1 and 2 respectively illustrated in FIGS. 6 and 7 represents beam patterns in a case where the angle θx of the main beam is varied to θx=0 degrees, 10 degrees, 20 degrees, 30 degrees, and 35 degrees.

As illustrated in FIG. 6, in the embodiment example, the maximum relative power of the main beam is illustrated near each of the angles θx of the beam direction Db=0 degrees, 10 degrees, 20 degrees, 30 degrees, and 35 degrees. In addition, the maximum relative power of each of side lobes SL0, SL10, SL20, SL30, and SL35 among a plurality of side lobes is illustrated in the beam patterns.

In the embodiment example, if the angle θx of the main beam is θx=0 degrees, the maximum relative power of the main beam is about 17.8 dB. The maximum relative power of the side lobe SL0 is about 6.1 dB. That is, the side lobe level is a level of about −11.7 dB. Likewise, in the case of θx=10 degrees, the side lobe level is a level of about −11.6 dB. In the case of θx=20 degrees, the side lobe level is a level of about −6.1 dB. In the case of θx=30 degrees, the side lobe level is a level of about −10.3 dB. In the case of θx=35 degrees, the side lobe level is a level of about −11.6 dB.

As illustrated in FIG. 7, in the comparison example, if the angle θx of the main beam is θx=0 degrees, the maximum relative power of the main beam is about 18.1 dB. The maximum relative power of the side lobe SL0 is about 5.2 dB. That is, the side lobe level is a level of about −12.9 dB. Likewise, in the case of θx=10 degrees, the side lobe level is a level of about −6.7 dB. In the case of θx=20 degrees, the side lobe level is a level of about −5.8 dB. In the case of θx=30 degrees, the side lobe level is a level of about −7.0 dB. In the case of θx=35 degrees, the side lobe level is a level of about −6.7 dB.

As described above, it is indicated that in the communication apparatus in the embodiment example, the maximum relative power in the case where the angle θx of the main beam is θx=0 degrees is slightly decreased compared with the comparison example, but the side lobe level at the time of inclining the angle θx of the main beam can be lowered.

(First Modification)

Figure 8:
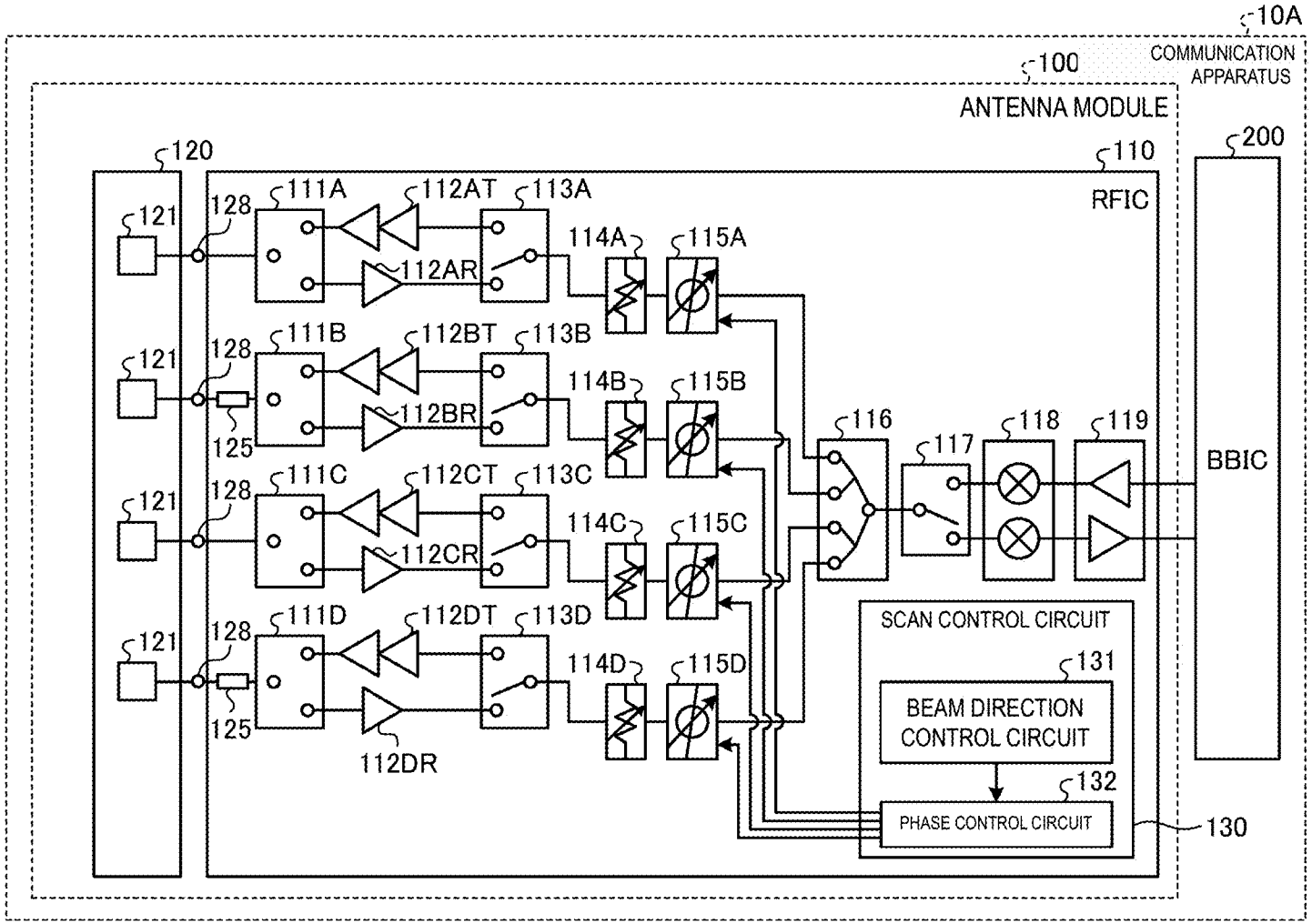
FIG. 8 is a block diagram illustrating the configuration of a communication apparatus according to a first modification.

FIG. 8 is a block diagram illustrating the configuration of a communication apparatus according to a first modification. Note that in the following description, the same components as those in the above-mentioned embodiment are denoted by the same reference numerals, and the description thereof is omitted. For the first modification, a configuration in which the RFIC 110 includes the fixed phase shifters 125 unlike the aforementioned first embodiment will be described.

As illustrated in FIG. 8, in a communication apparatus 10A of the first modification, each fixed phase shifter 125 is configured by using a wiring line included in the RFIC 110. Specifically, the fixed phase shifter 125 is configured by using the wiring line connecting a corresponding one of the switches 111B and 111D and a corresponding one of the terminals 128 of the RFIC 110. Note that any fixed phase shifter 125 is not provided between each of the switches 111A and 111C and a corresponding one of the terminals 128 of the RFIC 110. The length of each wiring line between the corresponding one of the switches 111B and 111D and the corresponding the terminals 128 of the RFIC 110 and the length of each wiring line between the corresponding one of the switches 111A and 111C and the corresponding terminal 128 of the RFIC 110 are normalized by using the wavelength λ and are made different, and thereby the fixed phase shifter 125 is configured.

Note that in the RFIC 110, the location where the fixed phase shifter 125 is provided is not limited to this location. The fixed phase shifter 125 may be provided in any location between the signal multiplexer/demultiplexer 116 and the corresponding terminal 128 in the signal paths.

Since the fixed phase shifter 125 is configured by using the wiring line of the RFIC 110 also in the first modification, an increase in the circuit scale of the RFIC 110 can be reduced. In addition, the transmission lines 123 provided in the antenna array 120 are not required to be changed, and thus the substrate 122 is manufactured easily.

Second Embodiment

Figure 9:
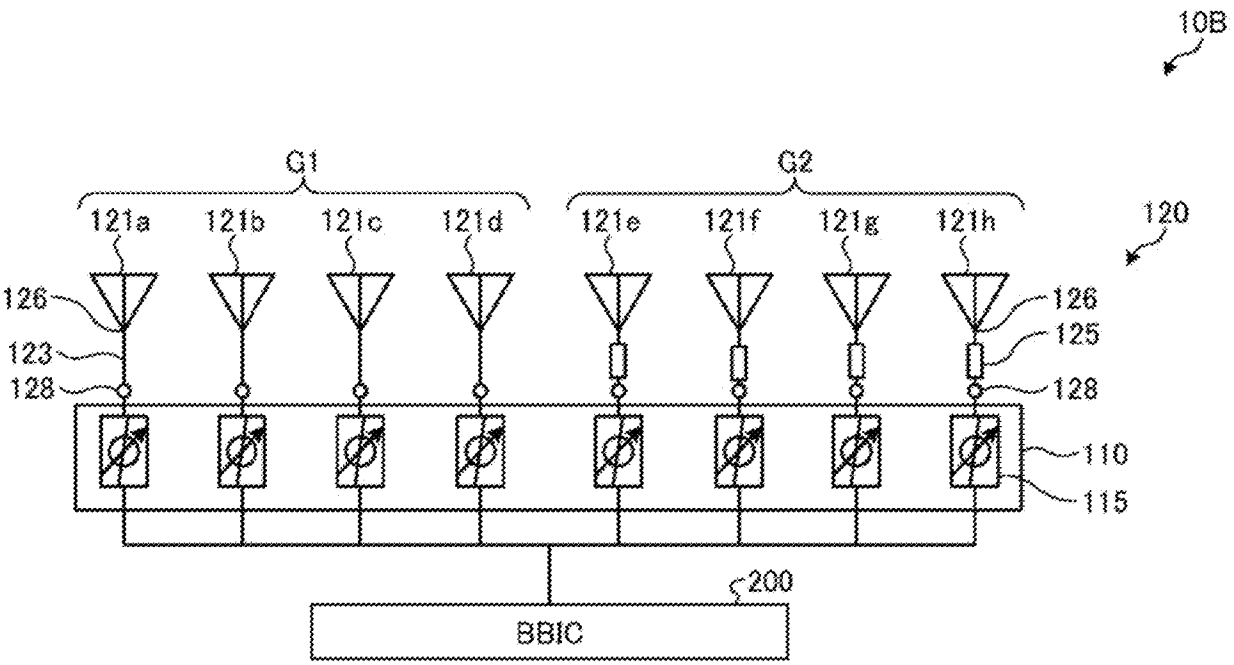
FIG. 9 is an explanatory diagram for explaining a connection relationship among a plurality of antenna elements and fixed phase shifters in a communication apparatus according to a second embodiment.

FIG. 9 is an explanatory diagram for explaining a connection relationship among a plurality of antenna elements and fixed phase shifters in a communication apparatus according to the second embodiment. For the second embodiment, a configuration in which each fixed phase shifter 125 is connected to one of an antenna element 121 among a plurality of first-group antenna elements G1 and an antenna element 121 among a plurality of second-group antenna elements G2 will be described, unlike the first embodiment and the first modification.

Specifically, as illustrated in FIG. 9, the plurality of antenna elements 121 include the plurality of first-group antenna elements G1 and the plurality of second-group antenna elements G2 different from the plurality of first-group antenna elements G1 and composed of the antenna elements 121 not included in the plurality of first-group antenna elements G1. For example, the plurality of first-group antenna elements G1 are configured by using the antenna elements 121*a*, 121*b*, 121*c*, and 121*d*. The plurality of second-group antenna elements G2 are configured by using the antenna elements 121*e*, 121*f*, 121*g*, and 121*h*.

The fixed phase shifters 125 are respectively connected to the plurality of antenna elements 121*e*, 121*f*, 121*g*, and 121*h* serving as the plurality of second-group antenna elements G2. The plurality of first-group antenna elements G1 are connected to the digital phase shifters 115 without the fixed phase shifters 125 interposed therebetween. Note that the configuration is not limited to this and may be a configuration in which the fixed phase shifters 125 are respectively connected to the plurality of antenna elements 121*a*, 121*b*, 121*c*, and 121*d* as the plurality of first-group antenna elements G1 and in which the plurality of second-group antenna elements G2 are connected to the digital phase shifters 115 without the fixed phase shifters 125 interposed therebetween. In addition, any selection may be made for the plurality of first-group antenna elements G1 and the plurality of second-group antenna elements G2.

The digital phase shifters 115 respectively connected to the plurality of first-group antenna elements G1 have the same set value that is one of the first phase values I1, I2, I3, and I4. That is, signals propagating through to the respective terminals 128 connected to the plurality of first-group antenna elements G1 do not have a phase difference and have the same phase value.

The digital phase shifters 115 respectively connected to the plurality of second-group antenna elements G2 have the same set value that is one of the first phase values I1, I2, I3, and I4. That is, signals propagating through to the respective terminals 128 connected to the plurality of second-group antenna elements G2 do not have a phase difference and have the same phase value. In addition, the fixed phase shifters 125 each cause the signals propagating through to the respective feeding points 126 of the plurality of second-group antenna elements G2 to have a phase difference of the offset phase value pos from each of the first phase values I1, I2, I3, and I4 of the plurality of first-group antenna elements G1.

Also, in a communication apparatus 10B in the second embodiment, like the above-mentioned first embodiment, a side lobe level in a direction inclined at the angle θx with the third direction Dz can be lowered.

(Second Modification)

Figure 10:
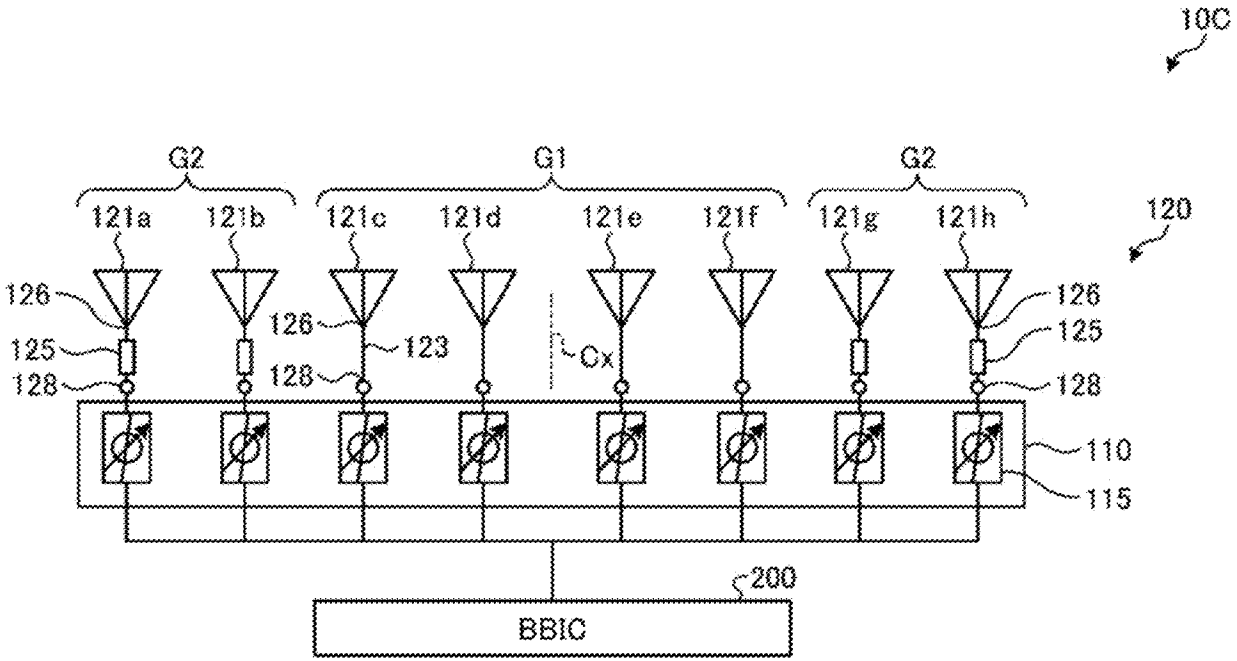
FIG. 10 is an explanatory diagram for explaining a connection relationship among a plurality of antenna elements and fixed phase shifters according to a second modification.

FIG. 10 is an explanatory diagram for explaining a connection relationship among a plurality of antenna elements and fixed phase shifters according to a second modification. For the second modification, a configuration in which the plurality of first-group antenna elements G1 and the plurality of second-group antenna elements G2 are arranged differently compared with the above-mentioned second embodiment will be described.

Any selection may be made for the plurality of first-group antenna elements G1 and the plurality of second-group antenna elements G2. For example, as illustrated in FIG. 10, the plurality of first-group antenna elements G1 are composed of the antenna elements 121*c*, 121*d*, 121*e*, and 121*f*. The plurality of second-group antenna elements G2 are composed of the antenna elements 121*a*, 121*b*, 121*g*, and 121*h*. The fixed phase shifters 125 are respectively connected to the plurality of antenna elements 121*a*, 121*b*, 121*g*, and 121*h* as the plurality of second-group antenna elements G2.

In a communication apparatus 10C of the second modification, the fixed phase shifters 125 are respectively connected to the antenna elements 121*a* and 121*h* arranged in the locations symmetrical with respect to the antenna center Cx. In addition, the fixed phase shifters 125 are respectively connected to the antenna elements 121*b* and 121*g*. In contrast, the fixed phase shifters 125 are not connected to the antenna elements 121*c* and 121*f* arranged in the locations symmetrical with respect to the antenna center Cx. Likewise, the fixed phase shifters 125 are not connected to the antenna elements 121*d* and 121*e*.

In the communication apparatus 10C of the second modification, the degree of freedom in arranging the fixed phase shifters 125 can be improved compared with the first embodiment, the second embodiment, and the first modification that are described above. Note that in the second embodiment and the second modification, the above-mentioned configuration of the first modification can be applied.

Third Embodiment

Figure 11:
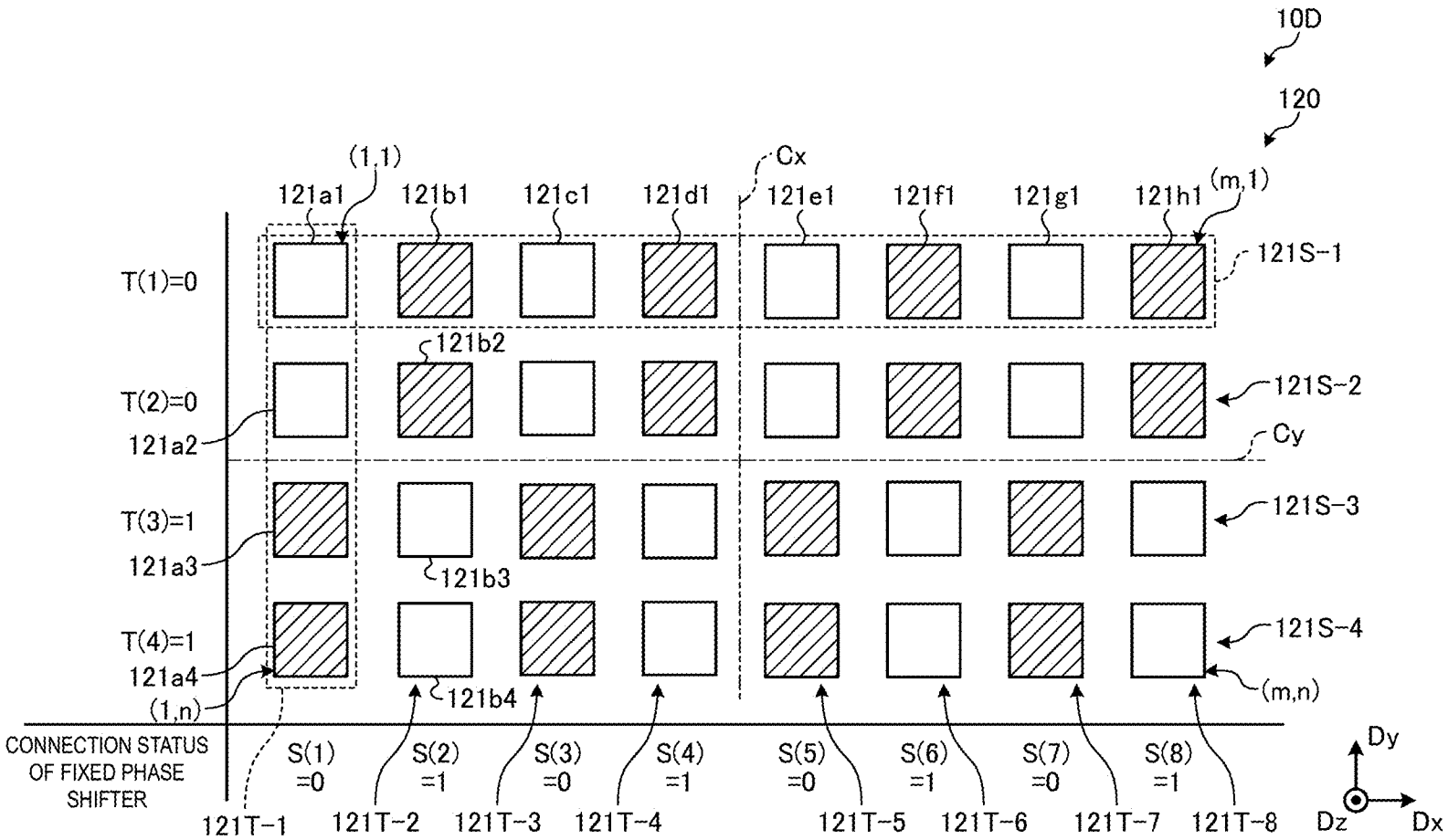
FIG. 11 is a plan view for explaining a connection relationship among a plurality of antenna elements and fixed phase shifters in a communication apparatus according to a third embodiment.

FIG. 11 is a plan view for explaining a connection relationship among a plurality of antenna elements and fixed phase shifters in a communication apparatus according to a third embodiment. For the third embodiment, unlike the first embodiment, the second embodiment, the first modification, and the second modification, a configuration in which the fixed phase shifters 125 are connected to the antenna elements 121 arranged in the first direction Dx and the second direction Dy will be described. Note that in FIG. 11, the antenna elements 121 connected with the fixed phase shifters 125 are expressed by putting diagonal lines.

As illustrated in FIG. 11, a plurality of antenna elements 121*a*1, 121*b*1, 121*c*1, 121*d*1, 121*e*1, 121*f*1, 121*g*1, and 121*h*1 are arranged in the first direction Dx. Antenna element rows 121S are each composed of the plurality of antenna elements 121 arranged in the first direction Dx. Antenna element rows 121S-1, 121S-2, 121S-3, and 121S-4 are arranged in the second direction Dy.

In each antenna element row 121S, each antenna element 121 connected with a fixed phase shifter 125 and each antenna element 121 not connected with a fixed phase shifter 125 are arranged alternately. In addition, in the antenna element row 121S, the antenna element 121 connected with the fixed phase shifter 125 and the antenna element 121 not connected with the fixed phase shifter 125 are arranged in the locations symmetrical with respect to the antenna center Cx.

The plurality of antenna elements 121*a*1, 121*a*2, 121*a*3, and 121*a*4 are arranged in the second direction Dy. Antenna element columns 121T are each composed of the plurality of antenna elements 121 arranged in the second direction Dy. Antenna element columns 121T-1, 121T-2, 121T-3, 121T-4, 121T-5, 121T-6, 121T-7, and 121T-8 are arranged in the first direction Dx.

In the antenna element column 121T-1, the respective fixed phase shifters 125 are not connected to the plurality of antenna elements 121*a*1 and 121*a*2, and the respective fixed phase shifters 125 are connected to the plurality of antenna elements 121*a*3 and 121*a*4. In addition, in the antenna element column 121T-2, the respective fixed phase shifters 125 are connected to the plurality of antenna elements 121*b*1 and 121*b*2, and the respective fixed phase shifters 125 are not connected to the plurality of antenna elements 121*b*3 and 121*b*4.

The arrangement of a connection pattern representing a connection relationship between each fixed phase shifter 125 and the corresponding antenna element 121 based on a pair of the antenna element column 121T-1 and the antenna element column 121T-2 is repeated from the antenna element column 121T-3 to the antenna element column 121T-8. In addition, in each antenna element column 121T, the antenna elements 121 connected with the respective fixed phase shifters 125 and the antenna elements 121 not connected with the fixed phase shifters 125 are arranged in the locations symmetrical with respect to an antenna center Cy.

The element number of each of the plurality of antenna elements 121 arranged in the first direction Dx and the second direction Dy is expressed as an element number (m, n); m(m=1, 2, . . . , or 8) is the element number of an antenna element 121 arranged in the first direction Dx; and n(n=1, 2, . . . , or 4) is the element number of the antenna element 121 arranged in the second direction Dy.

Information PSmn regarding a status of connection or a status of non-connection of an antenna element 121 having an element number (m, n) with a fixed phase shifter 125 is expressed by using Formula (3) below.

$$PSmn=(S(m))\mathrm{XOR}(T(n)) \quad (3),$$

where XOR is a logic symbol representing exclusive OR; S(m)(S(m)=0 or 1) is information representing a status of connection (S(m)=1) or a status of non-connection (S(m)=0), with a fixed phase shifter 125, of an antenna element 121 having an element number m and arranged in the first direction Dx; and T(n)(T(n)=0 or 1) is information representing a status of connection (T(n)=1) or a status of non-connection (T(n)=0), with the fixed phase shifter 125, of an antenna element 121 having an element number n and arranged in the second direction Dy.

A fixed phase shifter 125 is connected to an antenna element 121 having an element number (m, n) and having PSmn=1 according to Formula (3). In addition, a fixed phase shifter 125 is not connected to an antenna element 121 having an device number (m, n) and having PSmn=0 and is electrically connected to a digital phase shifter 115.

In a communication apparatus 10D of the third embodiment, even if the beam direction Db is taken in such a manner as to be inclined toward the first direction Dx and the second direction Dy with respect to the third direction Dz, side lobes can thereby be favorably lowered.

Fourth Embodiment

Figure 12:
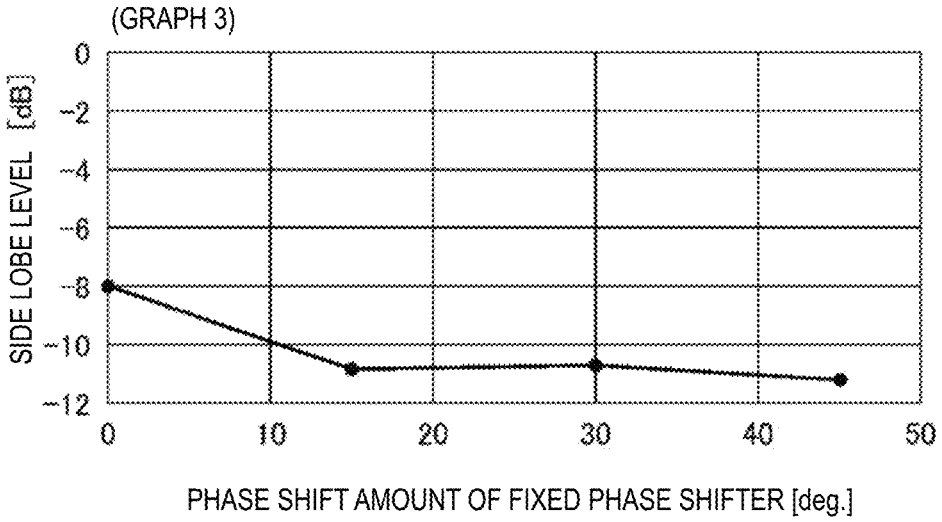
FIG. 12 is a graph illustrating a relationship between the phase shift amount of a fixed phase shifter and a side lobe level of a communication apparatus according to a fourth embodiment.

FIG. 12 is a graph illustrating a relationship between the phase shift amount of a fixed phase shifter and a side lobe level of a communication apparatus according to a fourth embodiment. For the fourth embodiment, unlike the embodiments and the modification each of which is described above, a case where the phase shift amount of each fixed phase shifter 125 is other than 45 degrees will be described.

In Graph 3 illustrated in FIG. 12, the horizontal axis represents the phase shift amount of a fixed phase shifter 125, and the vertical axis represents a side lobe level. Note that the phase shift amount of the fixed phase shifter 125 corresponds to the offset phase value pos illustrated in FIG. 5. In addition, in FIG. 12, phase shift amounts ranging from 0 degrees to 45 degrees are illustrated, and a relationship between a phase shift amount ranging from 45 degrees to 90 degrees and the side lobe level is omitted. However, side lobe levels relative to the phase shift amount ranging from 45 degrees to 90 degrees has a line-symmetrical relationship with those in FIG. 12 and are side lobe levels obtained by horizontally flipping the side lobe levels illustrated in FIG. 12 with respect to a virtual line passing through the phase shift amount of 45 degrees serving as a symmetry axis.

As illustrated in FIG. 12, the phase shift amount of 45 degrees of the fixed phase shifter 125 demonstrates the lowest side lobe level. Even if the phase shift amount of the fixed phase shifter 125 is deviated from 45 degrees, and even if the phase shift amount is 15 degrees or 30 degrees, the side lobe level is raised only slightly, and substantially the same side lobe level as in the case of the phase shift amount of 45 degrees is demonstrated. In a range in which the phase shift amount is lower than 15 degrees, the side lobe level is increased. As described above, it is indicated that the side lobe level can be lowered in the range in which the phase shift amount of the fixed phase shifter 125 is from 15 degrees to 45 degrees. As described above, it is indicated that if the relationship between the side lobe level and the phase shift amount illustrated in Graph 3 is extended to a range in which the phase shift amount is from 45 degrees to 90 degrees, the side lobe level can be lowered in a range in which the phase shift amount of the fixed phase shifter 125 is from 15 degrees to 75 degrees.

Note that the embodiments described above have been provided for easier understanding of the present disclosure and is not intended to limit the interpretation of the present disclosure. The present disclosure may be changed/improved without departing from the spirit thereof and includes its equivalents.

REFERENCE SIGNS LIST

10, 10A, 10B, 10C, 10D communication apparatus
100 antenna module

110 RFIC
115, 115A, 115B, 115C, 115D digital phase shifter
120 antenna array
121, 121*a*, 121*b*, 121*c*, 121*d*, 121*e*, 121*f*, 121*g*, 121*h* antenna element
122 substrate
123 transmission line
125 fixed phase shifter
P1, P2, P3, P4 antenna element pair
G1 plurality of first-group antenna elements
G2 plurality of second-group antenna elements
200 BBIC

The invention claimed is:

1. An antenna module comprising:

a plurality of antenna elements that are arranged in a first direction;

a fixed phase shifter; and a plurality of digital phase shifters that are each in a signal path to a corresponding one of the plurality of antenna elements, wherein each of the plurality of digital phase shifters respectively changes a phase of a signal to a first phase value provided discretely as the signal propagates through to a corresponding one of the plurality of antenna elements, the fixed phase shifter further changes the phase of the signal to a second phase value as the signal propagates through to the one of the plurality of antenna elements, the second phase value being obtained by adding a predetermined offset phase value to the first phase value, a middle point of a virtual line is set as an antenna center, the virtual line connecting, among the plurality of antenna elements arranged in the first direction, a center of an antenna element located on an end in the first direction and a center of an antenna element located on a different end in the first direction, and under a condition two antenna elements arranged in locations symmetrical with respect to the antenna center among the plurality of antenna elements arranged in the first direction are paired as an antenna element pair, and the fixed phase shifter is electrically connected to at least one antenna element of the antenna element pair.

2. The antenna module according to claim 1, wherein the at least one antenna element of the antenna element pair is electrically connected to a corresponding one of the digital phase shifters with the fixed phase shifter interposed between the one antenna element and the corresponding digital phase shifter, and wherein a different antenna element of the antenna element pair is electrically connected to a corresponding one of the digital phase shifters without the fixed phase shifter interposed between the different antenna element and the corresponding digital phase shifter.

3. The antenna module according to claim 1, wherein the plurality of antenna elements includes additional antenna elements that are arranged in a second direction orthogonal to the first direction, and wherein information PSmn regarding a status of connection or a status of non-connection of each of the plurality of antenna elements with the fixed phase shifter is expressed by a formula below, each of the plurality of antenna elements having an element number (m, n):

$$PSmn=(S(m))XOR(T(n)),$$

where

XOR is a logic symbol representing exclusive OR, m(m=1, 2, or . . . ) is an element number of an antenna element among the antenna elements arranged in the first direction, n(n=1, 2, or . . . ) is an element number of the antenna element among the additional antenna elements arranged in the second direction, S(m)(S(m)=0 or 1) is information representing the status of connection or the status of non-connection, with the fixed phase shifter, of an antenna element of the plurality of antenna elements arranged in the first direction and having an element number m, and T(n)(T(n)=0 or 1) is information representing the status of connection or the status of non-connection, with the fixed phase shifter, of an antenna element of the additional antenna elements arranged in the second direction and having an element number n.

4. The antenna module according to claim 2, wherein the plurality of antenna elements includes additional antenna elements that are arranged in a second direction orthogonal to the first direction, and wherein information PSmn regarding a status of connection or a status of non-connection of each of the plurality of antenna elements with the fixed phase shifter is expressed by a formula below, each of the plurality of antenna elements having an element number (m, n):

$$PSmn=(S(m))XOR(T(n)),$$

where

XOR is a logic symbol representing exclusive OR, m(m=1, 2, or . . . ) is an element number of an antenna element among the antenna elements arranged in the first direction, n(n=1, 2, or . . . ) is an element number of the antenna element among the additional antenna elements arranged in the second direction, S(m)(S(m)=0 or 1) is information representing the status of connection or the status of non-connection, with the fixed phase shifter, of an antenna element of the plurality of antenna elements arranged in the first direction and having an element number m, and T(n)(T(n)=0 or 1) is information representing the status of connection or the status of non-connection, with the fixed phase shifter, of an antenna element of the additional antenna elements arranged in the second direction and having an element number n.

5. The antenna module according to claim 1, wherein the offset phase value is a phase value that is half of a difference between adjacent first phase values among a plurality of the first phase values of each digital phase shifter.

6. The antenna module according to claim 2, wherein the offset phase value is a phase value that is half of a difference between adjacent first phase values among a plurality of the first phase values of each digital phase shifter.

7. The antenna module according to claim 1, further comprising:

a substrate provided with the plurality of antenna elements;

a radio frequency integrated circuit provided on a surface of the substrate; and a transmission line provided in the substrate and electrically connecting one of the plurality of antenna elements and the radio frequency integrated circuit, wherein at least part of the transmission line includes the fixed phase shifter.

8. The antenna module according to claim 2, further comprising:

a substrate provided with the plurality of antenna elements;

a radio frequency integrated circuit provided on a surface of the substrate; and a transmission line provided in the substrate and electrically connecting one of the plurality of antenna elements and the radio frequency integrated circuit, wherein at least part of the transmission line includes the fixed phase shifter.

9. The antenna module according to claim 5, further comprising:

a substrate provided with the plurality of antenna elements;

a radio frequency integrated circuit provided on a surface of the substrate; and a transmission line provided in the substrate and electrically connecting one of the plurality of antenna elements and the radio frequency integrated circuit, wherein at least part of the transmission line includes the fixed phase shifter.

10. The antenna module according to claim 1, further comprising:

a substrate provided with the plurality of antenna elements; and a radio frequency integrated circuit provided on a surface of the substrate, wherein the fixed phase shifter comprising a wiring line included in the substrate.

11. The antenna module according to claim 2, further comprising:

a substrate provided with the plurality of antenna elements; and a radio frequency integrated circuit provided on a surface of the substrate, wherein the fixed phase shifter comprising a wiring line included in the substrate.

12. An antenna module comprising:

a plurality of antenna elements;

a plurality of digital phase shifters that are each in a signal path to a corresponding one of the plurality of antenna elements, and a fixed phase shifter that changes a phase of a signal from a first phase value to a second phase value as the signal propagates through to one of the plurality of antenna elements, the second phase value being obtained by adding a predetermined offset phase value to a first phase value provided discretely by a corresponding one of the plurality of digital phase shifters, wherein the plurality of antenna elements include a plurality of first-group antenna elements and a plurality of second-group antenna elements that are composed of antenna elements not included in the plurality of first-group antenna elements, and wherein the fixed phase shifter is connected to at least one antenna element among the plurality of first-group antenna elements and an antenna element among the plurality of second-group antenna elements.

13. The antenna module according to claim 12, wherein the at least one of the antenna element among the plurality of first-group antenna elements and the antenna element among the plurality of second-group antenna elements is connected to a corresponding one of the digital phase shifters with the fixed phase shifter interposed between the corresponding digital phase shifter and the at least one antenna element among the plurality of first-group antenna elements and the antenna element among the plurality of second-group antenna elements, and wherein a different at least one antenna element among the plurality of first-group antenna elements and the antenna element among the plurality of second-group antenna elements is connected to a corresponding one of the digital phase shifters without the fixed phase shifter interposed between the corresponding digital phase shifter and the at least one of the antenna element among the plurality of first-group antenna elements and the antenna element among the plurality of second-group antenna elements.

14. The antenna module according to claim 12, wherein the offset phase value is a phase value that is half of a difference between adjacent first phase values among a plurality of the first phase values of each digital phase shifter.

15. The antenna module according to claim 13, wherein the offset phase value is a phase value that is half of a difference between adjacent first phase values among a plurality of the first phase values of each digital phase shifter.

16. The antenna module according to claim 12, further comprising:

a substrate provided with the plurality of antenna elements;

a radio frequency integrated circuit provided on a surface of the substrate; and a transmission line provided in the substrate and electrically connecting one of the plurality of antenna elements and the radio frequency integrated circuit, wherein at least part of the transmission line includes the fixed phase shifter.

17. The antenna module according to claim 13, further comprising:

a substrate provided with the plurality of antenna elements;

a radio frequency integrated circuit provided on a surface of the substrate; and a transmission line provided in the substrate and electrically connecting one of the plurality of antenna elements and the radio frequency integrated circuit, wherein at least part of the transmission line includes the fixed phase shifter.

18. The antenna module according to claim 12 further comprising:

a substrate provided with the plurality of antenna elements; and a radio frequency integrated circuit provided on a surface of the substrate, wherein the fixed phase shifter comprising a wiring line included in the substrate.

19. A communication apparatus comprising:

an antenna module; and a baseband integrated circuit that supplies a baseband signal to the antenna module, wherein the antenna module includes a plurality of antenna elements that are arranged in a first direction, a fixed phase shifter, and a plurality of digital phase shifters that are each in a signal path to a corresponding one of the plurality of antenna elements, wherein each of the plurality of digital phase shifters changes a phase of a signal to a first phase value provided discretely as the signal propagates through to a corresponding one of the plurality of antenna elements, the fixed phase shifter further changes the phase of the signal to a second phase value as the signal propagates through to the one of the plurality of antenna elements, the second phase value being obtained by adding a predetermined offset phase value to the first phase value, a middle point of a virtual line is set as an antenna center, the virtual line connecting, among the plurality of antenna elements arranged in the first direction, a center of an antenna element located on an end in the first direction and a center of an antenna element located on a different end in the first direction, and under a condition two antenna elements arranged in locations symmetrical with respect to the antenna center among the plurality of antenna elements arranged in the first direction are paired as an antenna element pair, and the fixed phase shifter is electrically connected to at least one antenna element of the antenna element pair.

* * * * *